US006943310B2

(12) United States Patent
Eisenhower

(10) Patent No.: US 6,943,310 B2
(45) Date of Patent: Sep. 13, 2005

(54) TOGGLE SWITCH APPARATUS

(75) Inventor: Gary W. Eisenhower, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/652,324

(22) Filed: Aug. 29, 2003

(65) Prior Publication Data

US 2005/0045464 A1 Mar. 3, 2005

(51) Int. Cl.[7] ..... H01H 13/00; H01H 3/00
(52) U.S. Cl. ..... 200/339; 200/302.3
(58) Field of Search ..... 200/339, 302.1, 200/302.3, 553

(56) References Cited

U.S. PATENT DOCUMENTS

| | | | | |
|---|---|---|---|---|
| 2,740,872 A | * | 4/1956 | Brodsky et al. | 200/302.1 |
| 3,008,024 A | | 11/1961 | Roeser | |
| 3,772,484 A | * | 11/1973 | Roeser | 200/4 |
| 3,828,148 A | * | 8/1974 | Roeser | 200/6 A |
| 4,109,126 A | * | 8/1978 | Halbeck | 200/302.3 |
| 4,110,585 A | * | 8/1978 | Brown | 200/305 |
| 4,215,257 A | | 7/1980 | Repplinger | |
| 4,376,926 A | * | 3/1983 | Senor | 337/104 |
| 5,158,172 A | | 10/1992 | Roeser et al. | 200/553 |
| 5,498,846 A | | 3/1996 | Chin | 200/557 |
| 6,040,543 A | | 3/2000 | Mina et al. | 200/559 |
| 6,160,227 A | | 12/2000 | Singer | 200/43.14 |
| 6,392,170 B1 | | 5/2002 | Wechsler | 200/43.21 |
| 6,420,669 B1 | | 7/2002 | Shenker et al. | 200/339 |
| 2002/0170807 A1 | | 11/2002 | Halphide | 200/43.16 |

OTHER PUBLICATIONS

PCT–Notification of Transmittal of the International Search Report and the Written Opinion of the International Searching Authority, or the Declaration, Mailed Mar. 22, 2005.

* cited by examiner

*Primary Examiner*—K. Richard Lee
(74) *Attorney, Agent, or Firm*—Kris T. Fredrick; Kermit D. Lopez; Luis M. Ortiz

(57) ABSTRACT

A toggle switch apparatus is disclosed, which includes a toggle mechanism and a plurality of basic switches maintained within a tubular housing. An actuator is associated with at least one spring which together can serve to actuate the plurality of basic switches. A lead wire termination assembly can also be configured within the tubular housing, wherein the lead wire termination assembly comprises a plurality of lead wires attached to a plurality of pin contacts that exit through a cover of the tubular housing, thereby permitting the toggle switch apparatus to be actuated manually in a maintained position during high gravity conditions. The tubular housing can be configured as a sealed metal tube. A header can also be sealed into the tubular housing utilizing a glass-to-metal seal.

16 Claims, 6 Drawing Sheets

SECTION B-B

SECTION B-B

SECTION A-A

TOGGLE SWITCH APPARATUS

TECHNICAL FIELD

The present invention is generally related to toggle switches. The present invention is also related to switches and components utilized in high-performance devices, such as military and commercial aircraft. The present invention is additionally related to actuator components utilized in switching mechanism.

BACKGROUND OF THE INVENTION

A toggle switch is a switch in which a projecting lever with a spring is used to open or to close an electric circuit. Toggle switches of various types have long been utilized to control power in domestic, commercial, industrial, and military applications for operating various electrical devices and equipment.

Known toggle switches typically are manufactured with a housing that contains electrical contacts and is fitted with a manually operable handle to switch power to externally mounted terminals. In one common form of a toggle switch, the handle has a cam surface internal to the housing that actuates a metallic leaf spring which in turn makes or breaks electrical conductivity with the contacts. Common toggle switches are standardized in terms of their mounting configurations such that they can readily be installed in wall-mounted electrical boxes, for example, with only the use of two screws. Typically, screw terminals are positioned on the sides of the switch housing such that connection can be easily made to electrical wires of suitable size to deliver power to electrical devices or equipment.

Toggle switches typically provide a manually accessible member which has metastability in a first position and a second position. For example, these positions may represent "ON" and "OFF". Some situations provide a substantial penalty for accidental actuation. For example, during repair or installation, accidental actuation may result in electrocution or shock. Therefore, where a worker is not in the immediate vicinity of a switch and is in the process of installation, repair or maintenance, often a lock or flag is placed to alert others that the switch should not be reset or to prevent resetting without significant efforts.

Situations also arise when it is necessary not only to prevent accidental actuation, but to actually maintain the toggle switch in an actuated position. An example of this type of situation is inherent in many high-gravity military applications, such as, for example, in high-performance military aircraft. The United States Department of the Navy, for example, requires the use of a momentary switch in F-16 fighter aircraft, which is located near the pilot's leg and must be held manually during tactical maneuvers.

Such a switch can be utilized to invert the flight controls while performing combat maneuvers. Problems with such a momentary switch can occur when a pilot pulls a high "G-force" maneuver and his or her flight suit begins to inflate to force blood in his or her body to prevent a blackout condition. When this situation occurs, the pilot has a difficult time holding the switch in the "ON" position, causing him to become disoriented while viewing the flight control panel.

A need thus exists for an improved toggle switch, which can be adapted for use in such high-performance applications, and which permits a pilot to maintain actuation of the toggle switch during high "G-force" maneuvers.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide an improved toggle switch.

It is another aspect of the present invention to provide improved switching components utilized in high-performance devices, such as military and commercial aircraft.

The aforementioned aspects of the invention and other objectives and advantages can now be achieved as described herein. A toggle switch apparatus is disclosed, which includes a toggle mechanism and a plurality of basic switches maintained within a tubular housing. An actuator is associated with at least one spring which together can serve to actuate the plurality of basic switches. A lead wire termination assembly can also be configured within the tubular housing.

The lead wire termination assembly comprises a plurality of lead wires attached to a plurality of pin contacts that exit through a cover of the tubular housing, thereby permitting the toggle switch apparatus to be actuated manually in a maintained position during high gravity conditions. The tubular housing can be configured as a sealed metal tube. A header can also be sealed into the tubular housing utilizing a glass-to-metal seal. The cover itself may be configured as a metal cover and the plurality of basic switches can comprise at least six basic switches, which are aligned in a row within the tubular housing.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 1:
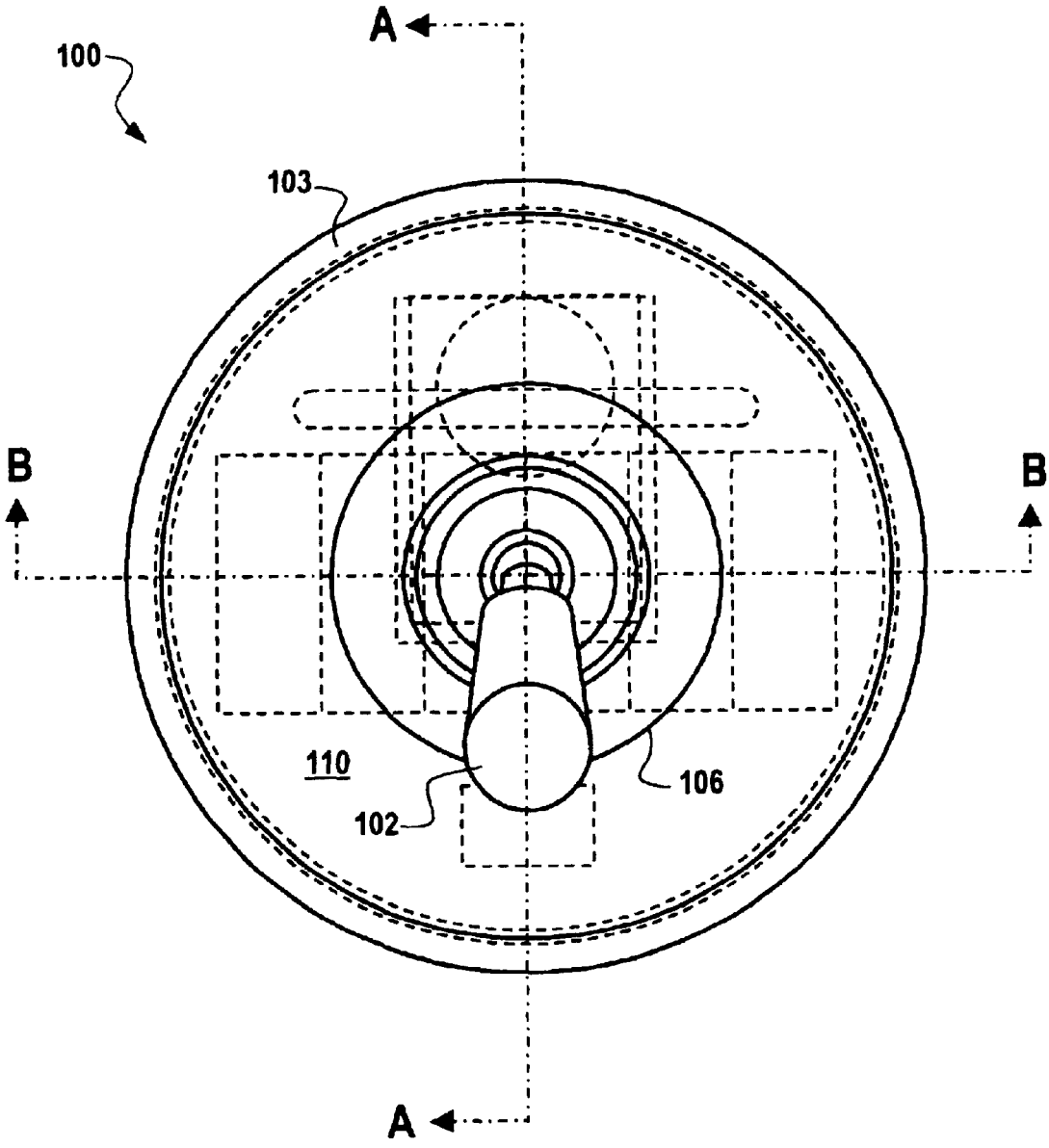
FIG. 1 illustrates a top sectional A—A view of a toggle switch apparatus, which can be implemented in accordance with an embodiment of the present invention.
Figure 2:
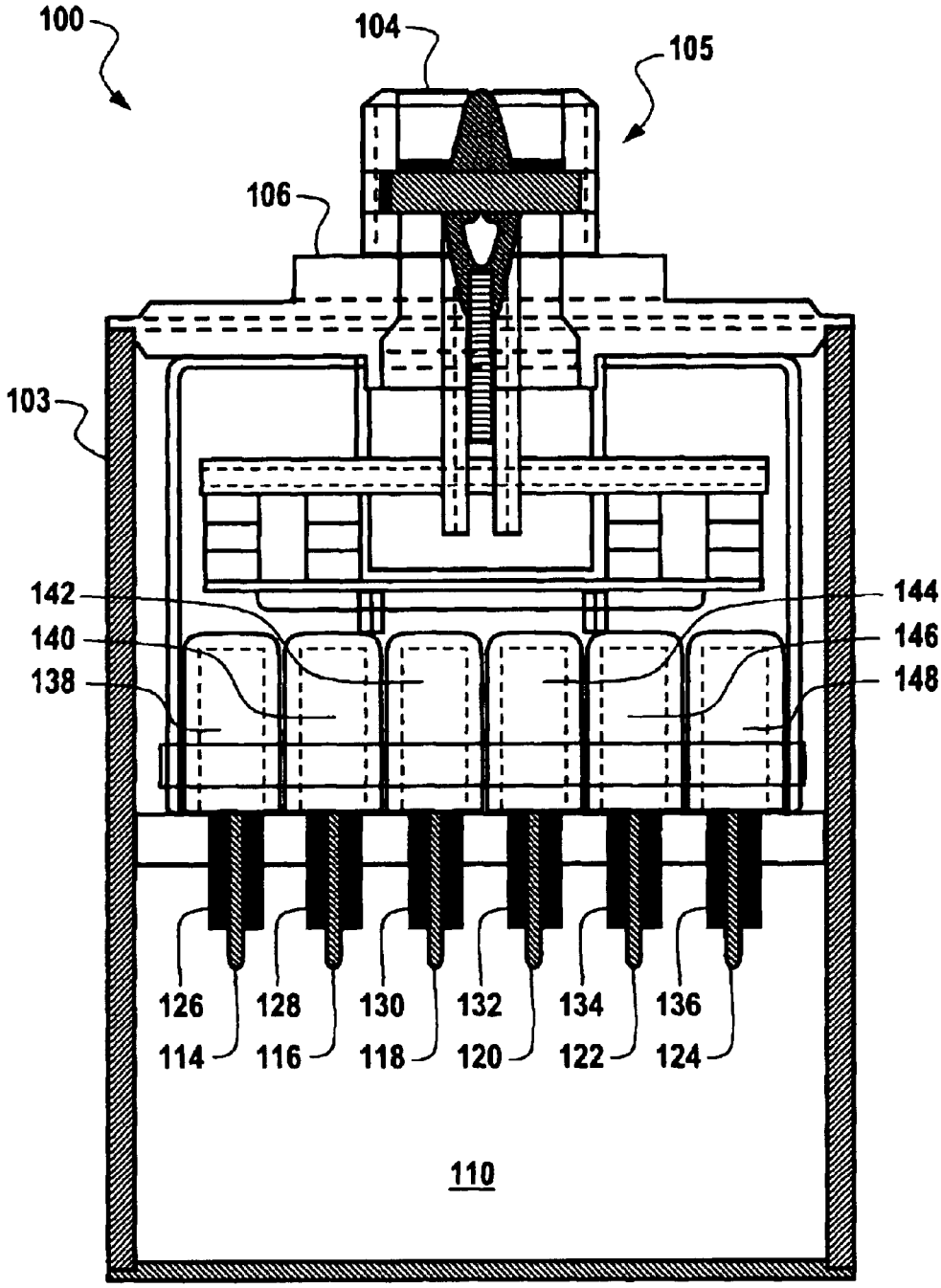
FIG. 2 illustrates a side sectional B—B view and an opposing view thereof of the toggle switch apparatus depicted in FIG. 1, in accordance with an embodiment of the present invention.
Figure 3:
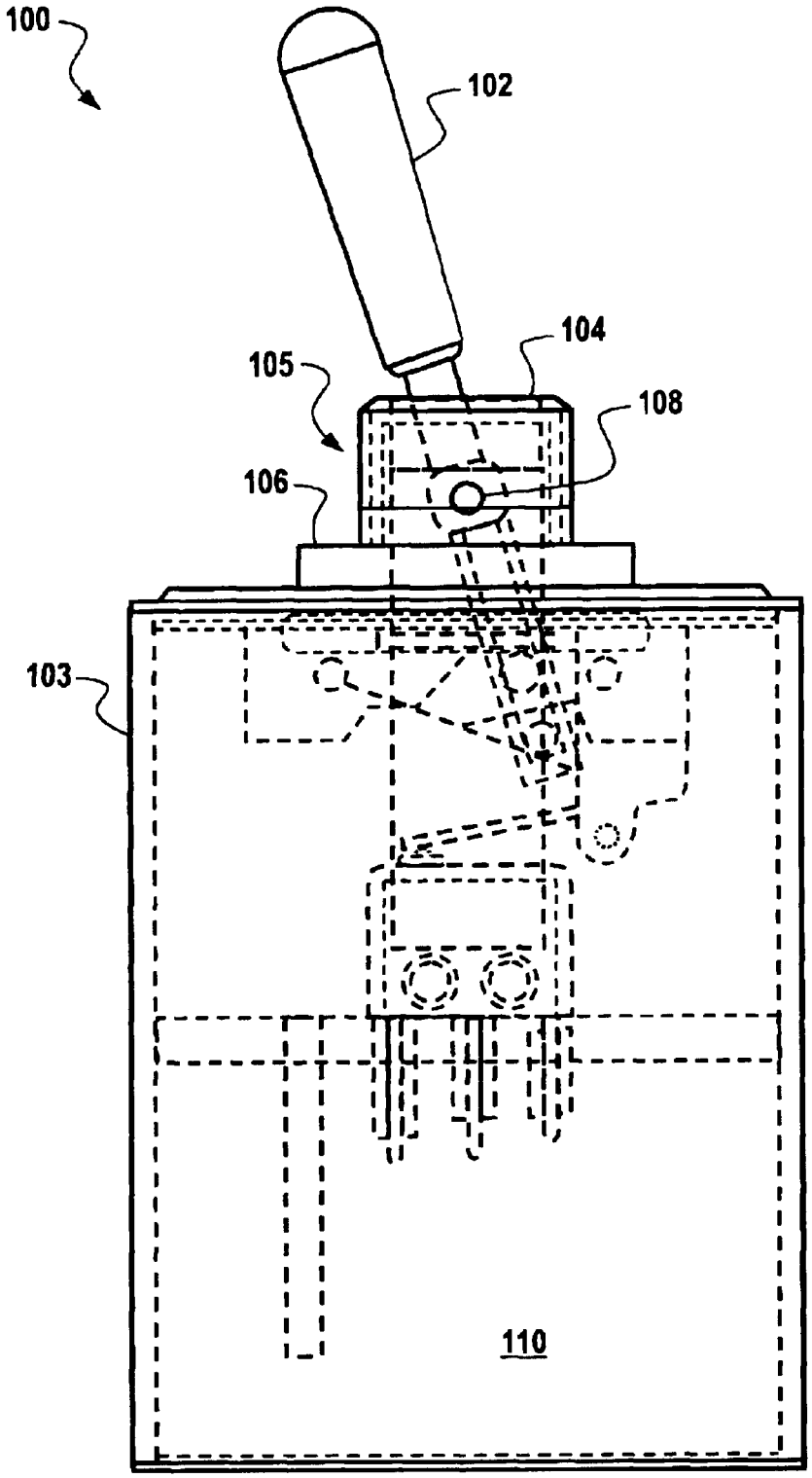
FIG. 3 illustrates an opposing view of the toggle switch apparatus depicted in FIG. 2, in accordance with an embodiment of the present invention.
Figure 4:
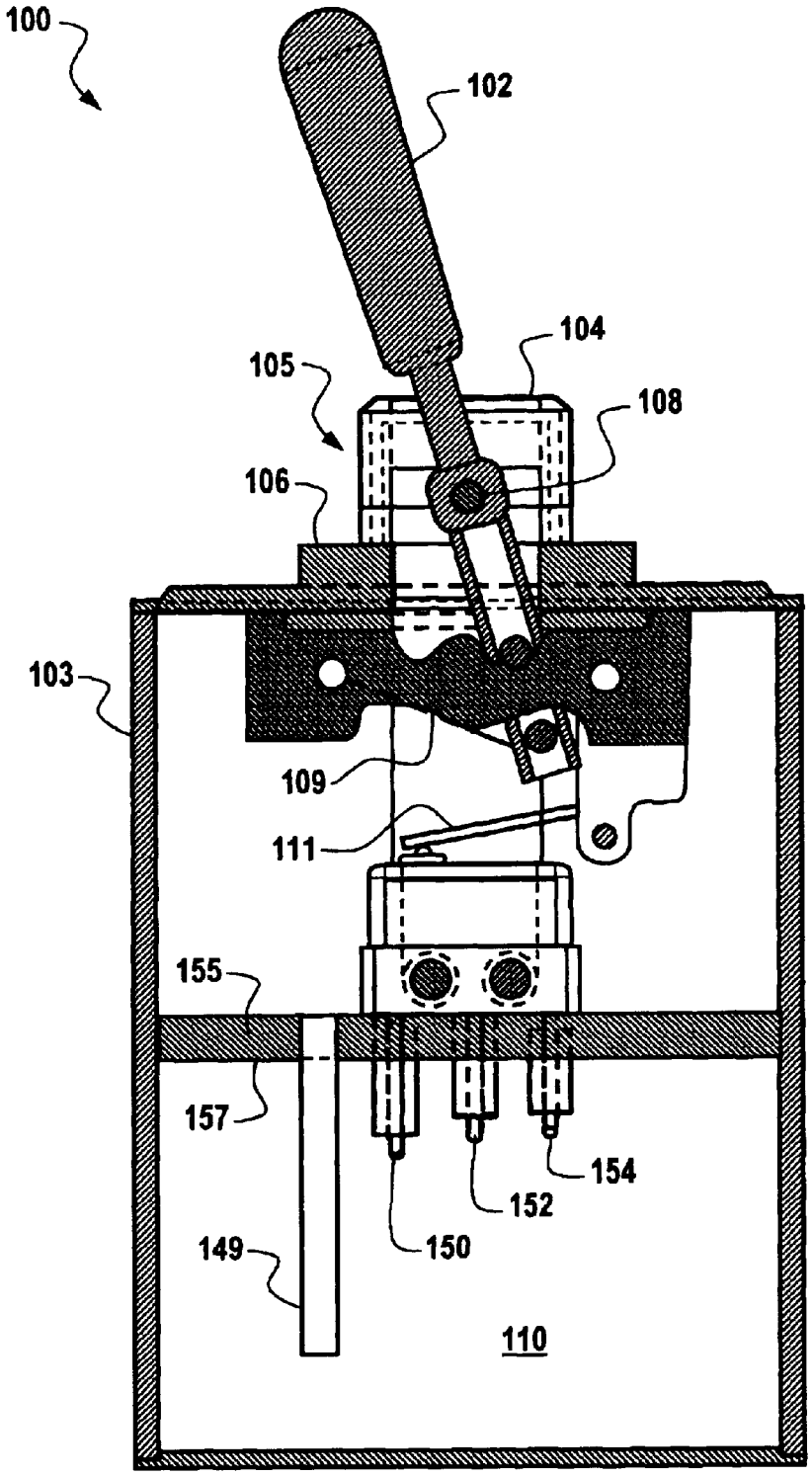
FIG. 4 illustrates a side sectional A—A view of the toggle switch apparatus depicted in FIGS. 1–3, in accordance with an embodiment of the present invention.

FIG. 1 illustrates a top sectional A—A view of a toggle switch apparatus 100, which can be implemented in accordance with an embodiment of the present invention. FIG. 2 illustrates a side sectional B—B view of the toggle switch apparatus 100 depicted in FIG. 1, in accordance with an embodiment of the present invention. FIG. 3 illustrates an opposing view of the toggle switch apparatus 100 depicted in FIG. 2. FIG. 4 illustrates a side sectional A—A view of the toggle switch apparatus 100 depicted in FIGS. 1–3, in accordance with an embodiment of the present invention. Note that in FIGS. 1–3, identical parts are indicated by identical reference numerals.

Toggle switch apparatus 100 generally includes a toggle mechanism 105 that includes a toggle 102 that is connected to a spring 109 which is associated with an actuator 111. Toggle mechanism 105 is also associated with a plurality of basic switches 114, 116, 118, 120, 122, and 124. Basic switches 114–124 are each surrounded respectively by insulators 126, 128, 130, 132, 134, and 136 and are located within a tubular housing 110. As indicated in FIG. 1, tubular housing 110 possesses a generally circular shape when viewed from the top. A support portion 106 of toggle switch apparatus 100 assists in maintaining toggle 102 centrally above the tubular housing 110. Walls 103 of tubular housing 110 also contribute to maintaining toggle 102 centrally above and connected to components within tubular housing 110. Actuator 111 and spring 109 can be utilized to actuate the basic switches 114, 116, 118, 120, 122, and 124.

A plurality of "basic" switches 138, 140, 142, 144, 146 and 148 are also provided, which can be configured as miniature environmental-sealed and/or miniature hermetically sealed basic switches. Both types of enclosed basic switches can utilize standard SM/UM/SX/UX components encased within a corrosion resistant aluminum housing to seal the precision switch contacts from contamination. Alternatively, standard SM/UM/SX/UX components can be utilized without such a metal housing, if the design implementation does not call out the need for environmental sealing.

Note that the term "basic switch" or simply "basic" as utilized herein generally refers to a self-contained switching unit. Such a switching unit (i.e., a basic switch) can be utilized alone or in a gang-mounted configuration built into assemblies thereof or enclosed within a metal housing. A tube portion 149 can be configured as a metal tube to pinch-off seal a hermetic seal thereof. Metal header pins 150,152,154 are also generally attached to a header 155 with a glass to metal seal that allows the basic switch pins to reside for electrical connection to the bottom side 157 of the header 155. Additionally, a metal guide profile 109 can maintains the toggle 102 in either direction.

Figure 5:
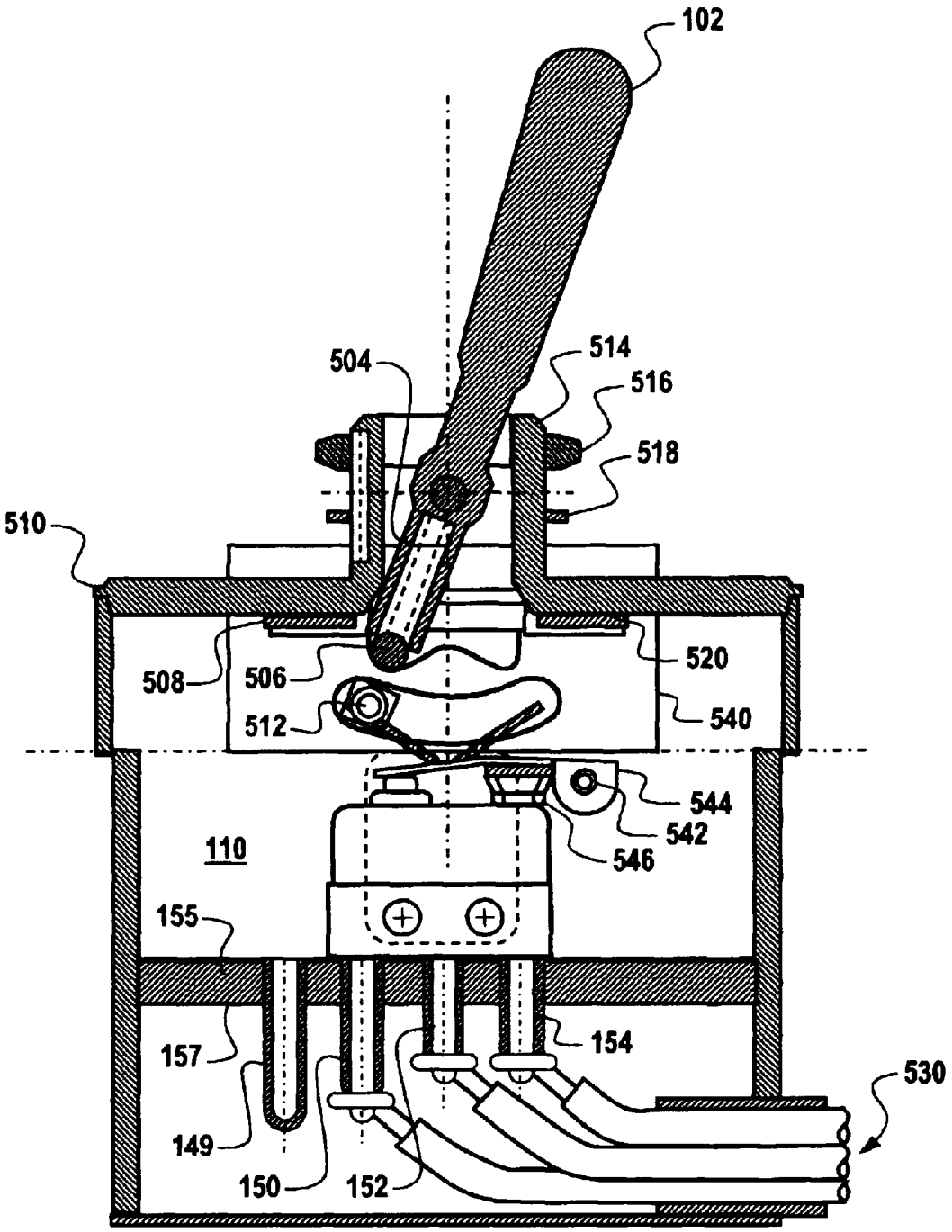
FIG. 5 illustrates a detailed side sectional view of the toggle switch depicted in FIGS. 1–4, in accordance with an embodiment of the present invention.
Figure 6:
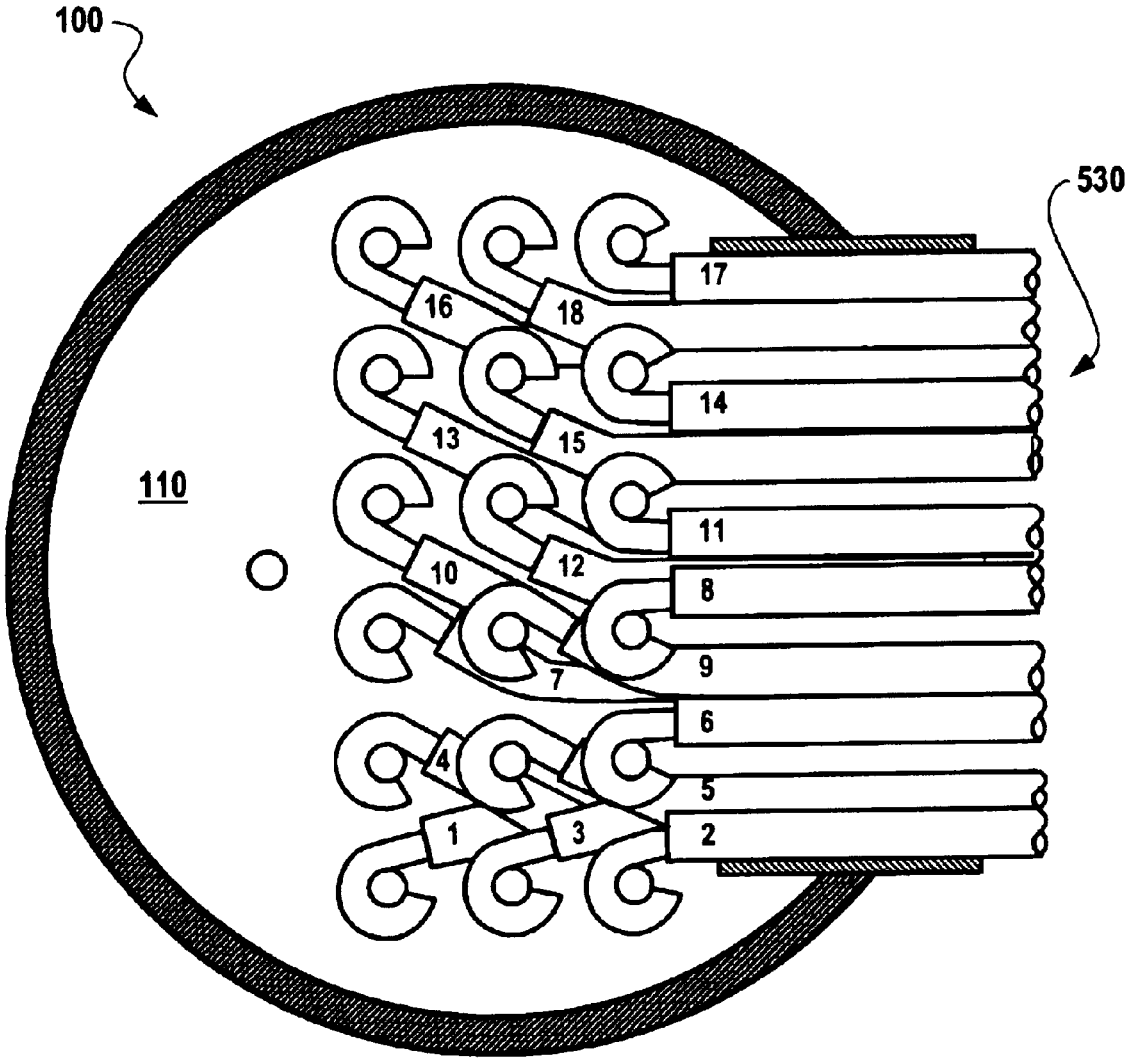
FIG. 6 illustrates a bottom view of the toggle switch apparatus depicted in FIGS. 1–5, in accordance with an embodiment of the present invention.

FIG. 5 illustrates a detailed side sectional view of the toggle switch depicted 100 in FIGS. 1–4, in accordance with an embodiment of the present invention. FIG. 6 illustrates a bottom view of the toggle switch apparatus 100 depicted in FIGS. 1–5, in accordance with an embodiment of the present invention. Note that in FIGS. 1–6, similar or identical parts are generally indicated by identical reference numerals. FIGS. 5 and 6 generally illustrate a lead wire termination assembly 530, which can be configured within said tubular housing 110, such that the lead wire termination assembly 530 comprises a group of lead wires attached to a plurality of pin contacts that exit through a cover of the tubular housing 110, thereby permitting the toggle switch apparatus 100 to be actuated manually in a maintained position during high gravity conditions.

A ball bearing 506 and a spring 504 can be configured to apply force to a switch component 508 located within toggle 102, which helps in maintaining the position of toggle 102 via a spring force/profile thereof. Ball bearing 508 can be configured with a metal bracket that is utilized to gang mount the basic switches 138, 140, 142, 144, 146, 148. Ball bearing 508 and ball bearing 520 comprise the same component. Reference numerals are only utilized to indicate opposing sides of the same component. A metal-to-metal joint 510 can also be provided which is welded together to provide a hermetic seal. Additionally, a metal pin 512 can be utilized to actuate a lever associated with the gang of switches.

A metal toggle housing chamber 514 can also be provided as a chamber lead-in for a threaded nut 516. Note that the threaded nut 516 can be configured as a 15/32-32 NS threaded nut. A star washer 518 can also be provided as a star washer to help prevent the washer 518 from backing off. Additionally, a roll pin 542 can be utilized to retain actuator 111 (i.e., an actuator plate). Note that component 544 is similar to ball bearing 508.

A coil spring 546 can also be provided to help lift the actuator plate (i.e., actuator 111) to prevent a false actuation. In FIG. 6, a cross-sectional view of the termination assembly 530 is shown, providing a bottom view of the toggle switch apparatus 100. The bottom cross-sectional view depicted in FIG. 6 generally illustrates the termination to the pins and the side exit of the cables from the metal housing 110. A metal plate can also be welded to the bottom of the tubular-shaped toggle switch apparatus 100 to help seal the components thereof. Such a metal plate can be epoxy-filled for environmental cable protection.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

What is claimed is:

1. A toggle switch apparatus, comprising:

a toggle mechanism associated with a plurality of basic switches maintained within a switching area within a tubular housing comprising a sealed metal tube;

a header which is sealed into said tubular housing and a glass-to-metal seal which seals said header into said tubular housing;

an actuator associated with at least one spring which actuates said plurality of basic switches, wherein said actuator and said at least one spring are located within said tubular housing; and a lead wire termination assembly configured within said tubular housing, wherein said lead wire termination assembly comprises a plurality of lead wires attached to a plurality of pin contacts that exit through a cover of said tubular housing, thereby permitting said toggle switch apparatus to be actuated manually in a maintained position during high gravity conditions while providing a hermetic seal via said tubular housing for said switching area and said plurality of basic switches to prevent contamination of said switching area and potential explosions thereof.

2. The apparatus of claim 1 wherein said plurality of basic switches comprises at least six basic switches.

3. The apparatus of claim 1 wherein said plurality of basic switches are aligned within said tubular housing in a row.

4. The apparatus of claim 1 wherein said cover comprises a metal cover.

5. The apparatus of claim 1 wherein said plurality of basic switches comprises at least one basic switch.

6. A toggle switch comprising:

a toggle mechanism associated with a plurality of basic switches maintained within a switching area within a tubular housing comprising a sealed metal tube, wherein said plurality of basic switches comprises at least six basic switches aligned within said tubular housing in a row;

an actuator associated with at least one spring which actuates said plurality of basic switches, wherein said actuator and said at least one spring are located within said tubular housing; and a lead wire termination assembly configured within said tubular housing, wherein said lead wire termination assembly comprises a plurality of lead wires attached to a plurality of pin contacts that exit through a cover of said tubular housing, thereby permitting said toggle switch apparatus to be actuated manually in a maintained position during high gravity conditions while providing a hermetic seal via said tubular housing for said switching area and said plurality of basic switches to prevent contamination of said switching area and potential explosions thereof.

7. A toggle switch method, comprising the steps of:

associating a toggle mechanism with a plurality of basic switches maintained within a switching area of a tubular housing comprising metal;

sealing a header into said tubular housing utilizing a glass-to-metal seal;

associating an actuator with at least one spring for actuating said plurality of basic switches, wherein said actuator and said at least one spring are located within said tubular housing; and providing a lead wire termination assembly within said tubular housing, wherein said lead wire termination assembly comprises a plurality of lead wires attached to a plurality of pin contacts that exit through a cover of said tubular housing, thereby permitting said toggle switch apparatus to be actuated manually in a maintained position during high gravity conditions while providing a hermetic seal via said tubular housing for said switching area and said plurality of basic switches to prevent contamination of said switching area and potential explosions thereof.

8. The method of claim 7 further comprising the step of configuring said tubular housing to comprise a sealed metal tube.

9. The method of claim 7 wherein said plurality of basic switches comprises at least six basic switches.

10. The method of claim 7 further comprising the step of aligning said at least six basic switches in a row within said tubular housing.

11. The method of claim 7 wherein said cover comprises a metal cover.

12. The method of claim 7 wherein said plurality of basic switches comprises at least one basic switch.

13. A toggle switch method, comprising the steps of:

associating a toggle mechanism with a plurality of basic switches maintained within a switching area of a tubular housing comprising metal, wherein said plurality of basic switches comprises at least six basic switches;

aligning said at least six basic switches in a row within said tubular housing;

associating an actuator with at least one spring for actuating said plurality of basic switches, wherein said actuator and said at least one spring are located within said tubular housing; and providing a lead wire termination assembly within said tubular housing, wherein said lead wire termination assembly comprises a plurality of lead wires attached to a plurality of pin contacts that exit through a cover of said tubular housing, thereby permitting said toggle switch apparatus to be actuated manually in a maintained position during high gravity conditions while providing a hermetic seal via said tubular housing for said switching area and said plurality of basic switches to prevent contamination of said switching area and potential explosions thereof.

14. A toggle switch system, comprising:

an electronic system under a control of a toggle mechanism associated with a plurality of basic switches maintained within switching area within a tubular housing comprising metal;

an actuator associated with at least one spring which actuates said plurality of basic switches, wherein said actuator and said at least one spring are located within said tubular housing; and a lead wire termination assembly configured within said tubular housing, wherein said lead wire termination assembly comprises a plurality of lead wires attached to a plurality of pin contacts that exit through a cover of said tubular housing;

a header which is sealed into said tubular housing and a glass-to-metal seal which seals said header into said tubular housing, and wherein said cover comprises a metal cover, thereby permitting said toggle switch apparatus to be actuated manually in a maintained position during high gravity conditions while providing a hermetic seal via said tubular housing for said switching area and said plurality of basic switches to prevent contamination of said switching area and potential explosions thereof during said high gravity conditions.

15. The system of claim 14 wherein said tubular housing comprises a sealed metal tube.

16. The system of claim 14 wherein said electronic system comprises a high-performance aircraft.

* * * * *